US010192697B2

(12) United States Patent
Hsiao

(10) Patent No.: US 10,192,697 B2
(45) Date of Patent: Jan. 29, 2019

(54) KEY AND KEYBOARD DEVICE

(71) Applicant: ASUSTEK COMPUTER INC., Taipei (TW)

(72) Inventor: Li-Sheng Hsiao, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 15/724,822

(22) Filed: Oct. 4, 2017

(65) Prior Publication Data

US 2018/0102225 A1 Apr. 12, 2018

(30) Foreign Application Priority Data

Oct. 12, 2016 (TW) ..... 105132927 A

(51) Int. Cl.

| | |
|---|---|
| ***H01H 13/14*** | (2006.01) |
| ***H01H 13/10*** | (2006.01) |
| ***H01H 3/12*** | (2006.01) |
| *H01H 9/18* | (2006.01) |

(52) U.S. Cl.

CPC ..... *H01H 13/14* (2013.01); *H01H 3/125* (2013.01); *H01H 13/10* (2013.01); *H01H 2009/187* (2013.01); *H01H 2221/08* (2013.01); *H01H 2227/002* (2013.01); *H01H 2227/036* (2013.01); *H01H 2229/02* (2013.01); *H01H 2229/05* (2013.01)

(58) Field of Classification Search

CPC ..... H01H 3/125; H01H 13/14; H01H 13/10

USPC ..... 200/5 A, 344

See application file for complete search history.

(56) References Cited

U.S. PATENT DOCUMENTS

| | | | | |
|---|---|---|---|---|
| 5,399,822 A * | 3/1995 | Sato | H01H 3/125 200/344 |
| 6,689,977 B2 * | 2/2004 | Ito | H01H 3/125 200/344 |
| 7,312,414 B2 * | 12/2007 | Yatsu | H01H 3/125 200/344 |

FOREIGN PATENT DOCUMENTS

| | | |
|---|---|---|
| CN | 202042399 U | 11/2011 |
| CN | 202067711 U | 12/2011 |
| TW | M512202 U | 11/2015 |
| TW | M512738 U | 11/2015 |
| TW | M524990 U | 7/2017 |

* cited by examiner

*Primary Examiner* — Edwin A. Leon

(74) *Attorney, Agent, or Firm* — Muncy, Geissler, Olds & Lowe, P.C.

(57) ABSTRACT

A key is disclosed herein. The key is disposed on a baseplate of a keyboard device, and comprises a sheet metal keycap and a supporting structure. The sheet metal keycap includes a body portion and two bending portions. The two bending portions are formed by extending downward from a side of two punching holes on the body portion, respectively. The supporting structure is disposed between the sheet metal keycap and the baseplate. Two sides of the supporting structure are pivotally connected to the bending portions and the baseplate, respectively. The key is thinner due to sheet metal keycap which is integratedly formed. A keyboard device with a plurality keys is also provided herein.

10 Claims, 9 Drawing Sheets

KEY AND KEYBOARD DEVICE

CROSS-REFERENCE TO RELATED APPLICATION

This application claims the priority benefit of TW application serial No. 105132927, filed on Oct. 12, 2016. The entirety of the above-mentioned patent application is hereby incorporated by references herein and made a part of specification.

BACKGROUND OF THE INVENTION

Field of the Invention

The disclosure relates to a key and a keyboard device.

Description of the Related Art

A consumer electronic device, such as an ultrabook or a Bluetooth keyboard for a tablet computer trends to be thin and light. Consequently, reducing the thickness of the key facilitates would minimize the thickness of the whole keyboard. A keycap is usually made of plastic. To keep a key in a high strength, a thickness of the plastic keycap cannot be thin. Consequently, the whole keyboard device is difficult to be thin. A plastic piece can be easily manufactured into a complicated connecting structure via an injection molding method where a metal materiel cannot. A metal piece needs to be placed on a plastic substrate and following with a further forming process. As a result, the forming process with a metal is complicated.

BRIEF SUMMARY OF THE INVENTION

According to an aspect of the disclosure, a key is provided. The key is disposed on a baseplate of a keyboard device and comprises a sheet metal keycap and a supporting structure. The sheet metal keycap includes a body portion and two bending portions. And the two bending portions are formed by extending downwardly from a side of two punching holes of the body portion, respectively. The supporting structure is disposed between the sheet metal keycap and the baseplate. And two sides of the supporting structure are pivotally connected to the bending portions and the baseplate, respectively.

According to another aspect of the disclosure, a keyboard device is provided. The keyboard device comprises a baseplate and a plurality of keys. The baseplate includes a fixing portion and a slot. The keys are disposed on the baseplate. The key includes a sheet metal keycap and a supporting structure. The sheet metal keycap includes a body portion and two bending portions. The two bending portions are formed by extending downwardly from a side of two punching holes of the body portion, respectively. The supporting structure is disposed between the sheet metal keycap and the baseplate, and two sides of the supporting structure are pivotally connected to the bending portions and the baseplate, respectively.

BRIEF DESCRIPTION OF THE DRAWINGS

These and other features, aspects and advantages of the invention will become better understood with regard to the following embodiments and accompanying drawings.

DETAILED DESCRIPTION OF THE EMBODIMENTS

A key and a keyboard device with a sheet metal keycap are illustrated by referring to related drawings. The similar components are denoted by the same symbols.

Figure 1:
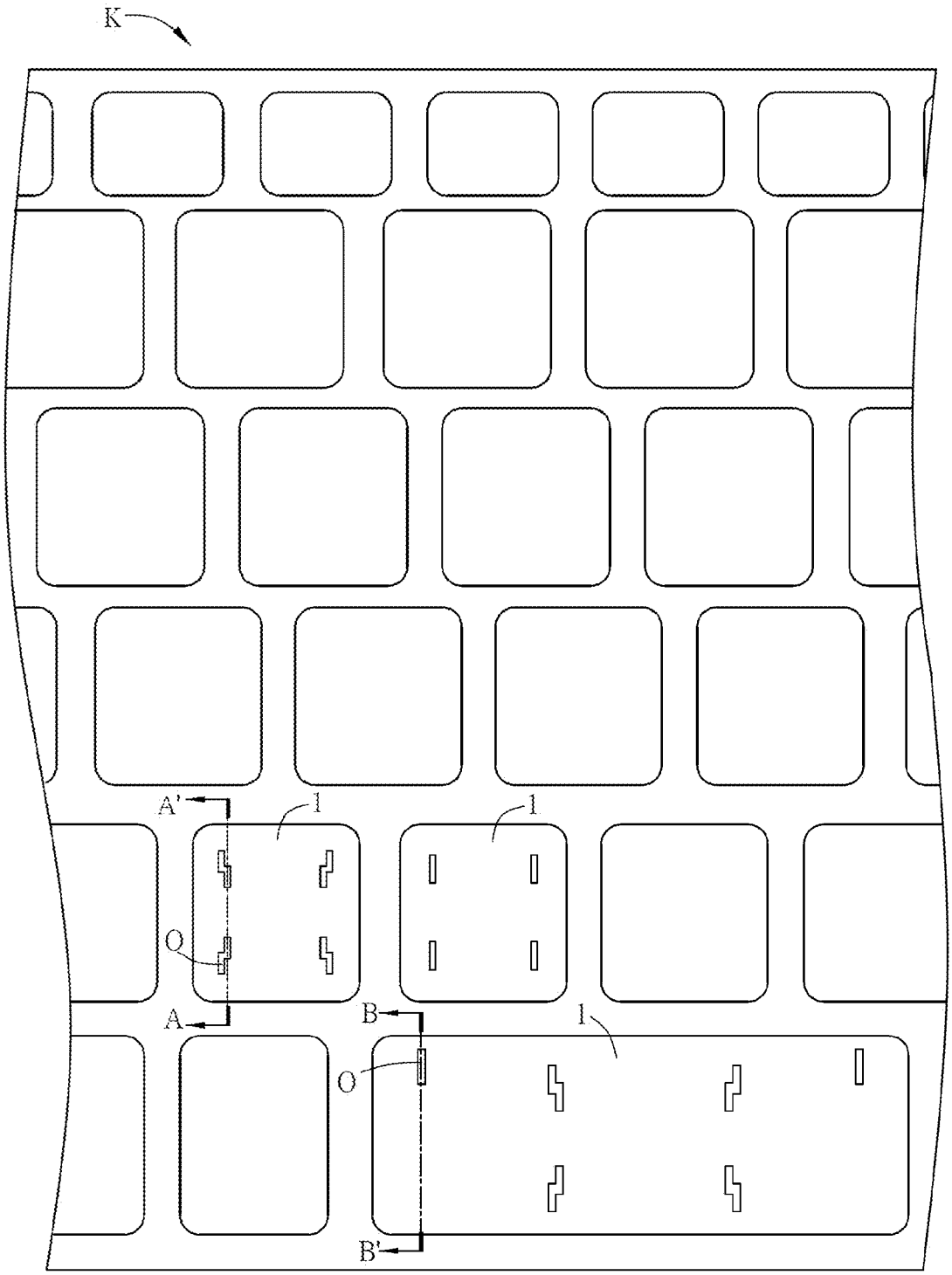
FIG. 1 is a schematic diagram showing a keyboard device in an embodiment.
Figure 2A:
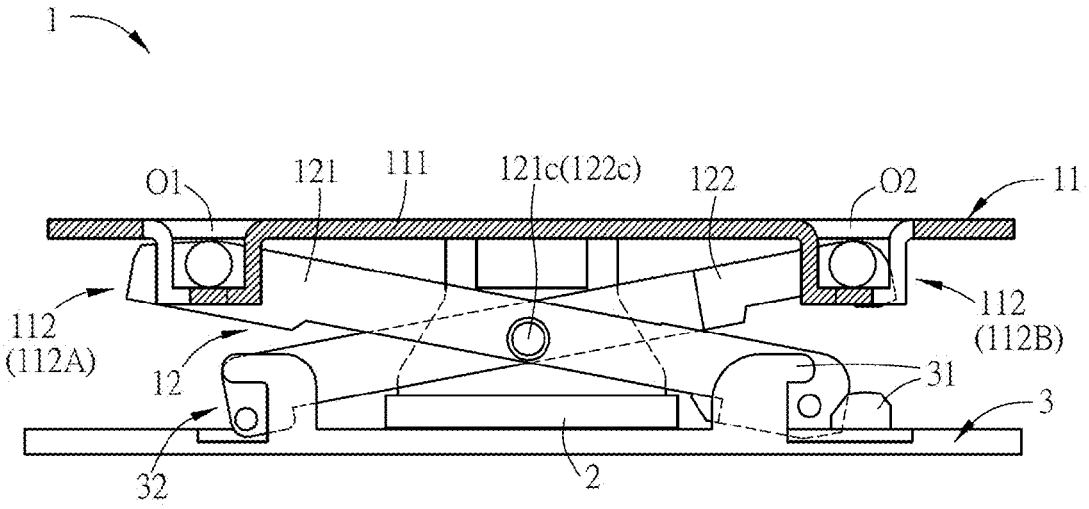
FIG. 2A is a section view showing a key along A-A' line in FIG. 1 in an embodiment.
Figure 2B:
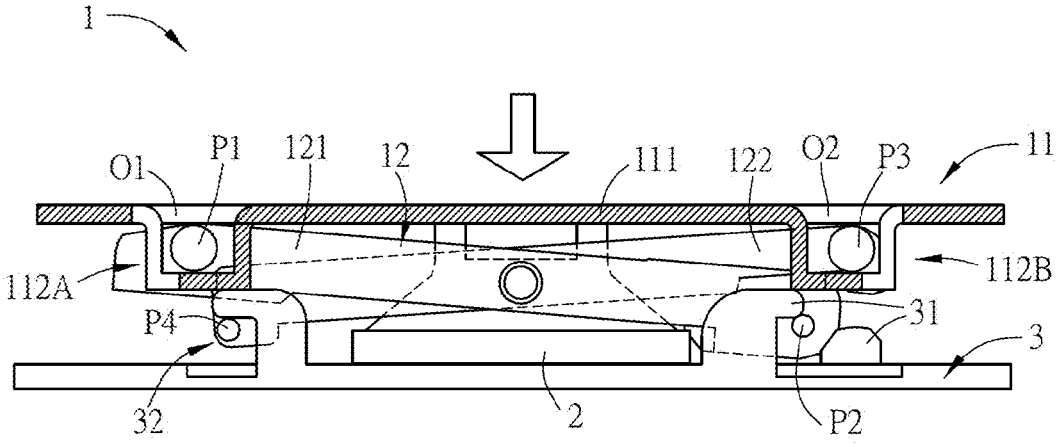
FIG. 2B is a schematic diagram showing a key shown in FIG. 2A after pressed in an embodiment.

Please refer to FIG. 1, FIG. 2A to FIG. 2B, FIG. 1 is a schematic diagram showing a keyboard device K in an embodiment. FIG. 2A is a section view showing a key along A-A' line in FIG. 1 in an embodiment. FIG. 2B is a schematic diagram showing a key shown in FIG. 2A is pressed. In FIG. 1, only part of keys 1 are shown with punching holes O and bending portions 112 for clarity, which is not limited herein.

In an embodiment, the key 1 is disposed on a baseplate 3 of the keyboard device K. The keyboard device K includes a rubber cap 2 disposed on the baseplate 3. The baseplate 3 includes a fixing portion 31 and a slot 32. The key 1 includes a sheet metal keycap 11 and a supporting structure 12. The sheet metal keycap 11 includes a body portion 111 and at least two bending portions 112A, 112B. The body portion 111 includes at least two punching holes O1, O2 corresponding to the bending portions 112A, 112B. The bending portions 112A, 112B are extended downwardly along a side of the corresponding punching holes O1, O2 from the body portion 111, respectively. The bending portions 112A, 112B are connected the supporting structure 12 pivotally. The supporting structure 12 is disposed between the sheet metal keycap 11 and the baseplate 3. The two sides of the supporting structure 12 are pivotally connected to the two bending portions 112A, 112B and the baseplate 3, respectively. The rubber cap 2 is disposed between the sheet metal keycap 11 and the baseplate 3.

In an embodiment, the supporting structure 12 of the key 1 includes a first support 121 and a second support 122. The rubber cap 2 is disposed between the first support 121 and the second support 122. A side of the first support 121 is pivotally connected to the bending portion 112A. The other side of the first support 121 is pivotally connected to the fixing portion 31 of the baseplate 3. A side of the second support 122 is pivotally connected to the bending portion 112B. The other side of the second support 122 is disposed inside the slot 32 of the baseplate 3. The first support 121 is connected to the second support 122 via the pivot connection between a portion 122*c* adjacent to a middle of the second support with a portion 121*c* adjacent to a middle of the first support. In an embodiment, the pivot position of the first support 121 and the second support 122 is in the middle. In an embodiment, the pivot position of the first support 121 and the second support 122 is adjacent to the middle portion.

In an embodiment, the bending portions 112A, 112B of the key 1 are formed by bending the body portion 111 after the punching holes O1, O2 are formed. The bending portions 112A, 112B and the body portion 111 are integratedly formed. The bending portion 112 is configured to be pivotally connected to a side of the first support 121 or a side of the second support 122.

In an embodiment, the material of the sheet metal keycap 11 includes but not limited to: steel plate, galvanized iron sheet, tin plated steel sheet, stainless steel plate, copper and copper alloy plate, aluminum and aluminum alloy plate and so on. The material of the supporting structure 12 includes but not limited to metal, plastic, rubber or other high polymer material.

FIG. 2B is a schematic diagram showing a key shown in FIG. 2A after pressed in an embodiment. In an embodiment, when the sheet metal keycap 11 is pressed, the sheet metal keycap 11 moves downwardly in a straight line along a direction perpendicular to the baseplate 3. The first support 121 and the sheet metal keycap 11 are cooperated with each other and rotated via the pivot position P1, P2. The second support 122 and the sheet metal keycap 11 are cooperated with each other and rotated via the pivot position P3. The pivot position P4 moves along a straight line along the slot 32.

In an embodiment, the rubber cap 2 is elastic. When the sheet metal keycap 11 is pressed, the rubber cap 2 is deformed with the movement of the sheet metal keycap 11. When the pressure applied on the sheet metal keycap 11 is eliminated, the sheet metal keycap 11 restores to an original position via a returning force provided by the rubber cap 2, the first support 121 and the second support 122.

In an embodiment, the bending portions 112 are in different shapes. Please refer to FIG. 2A and FIG. 3A to FIG. 3G FIG. 3A is a top view showing a bending portion 112 and a section view along C-C' line. In the section view of the sheet metal keycap 11, the bending portions 112*a*, 112*b* are extended downward from the body portion 111 along a side of the corresponding punching hole O1, respectively. The bending portions 112*a*, 112*b* are combined with the first support 121 at the pivot position P1. That is, the bending portions 112*a*, 112*b* are formed at the body portion 111 of the sheet metal keycap 11 by punching to clamp a side of the first support 121. In an embodiment, the bending portions 112*a*, 112*b* are a duckbill type structure in the section view. Similarly, the bending portions 112*c*, 112*d* are extended downward from the body portion 111 along a side of the punching hole O2 and combined with the second support 122 in the pivot position P3. In the embodiment, the bending portions 112*c*, 112*d* are a duckbill type structure in the section view.

Figure 3A:
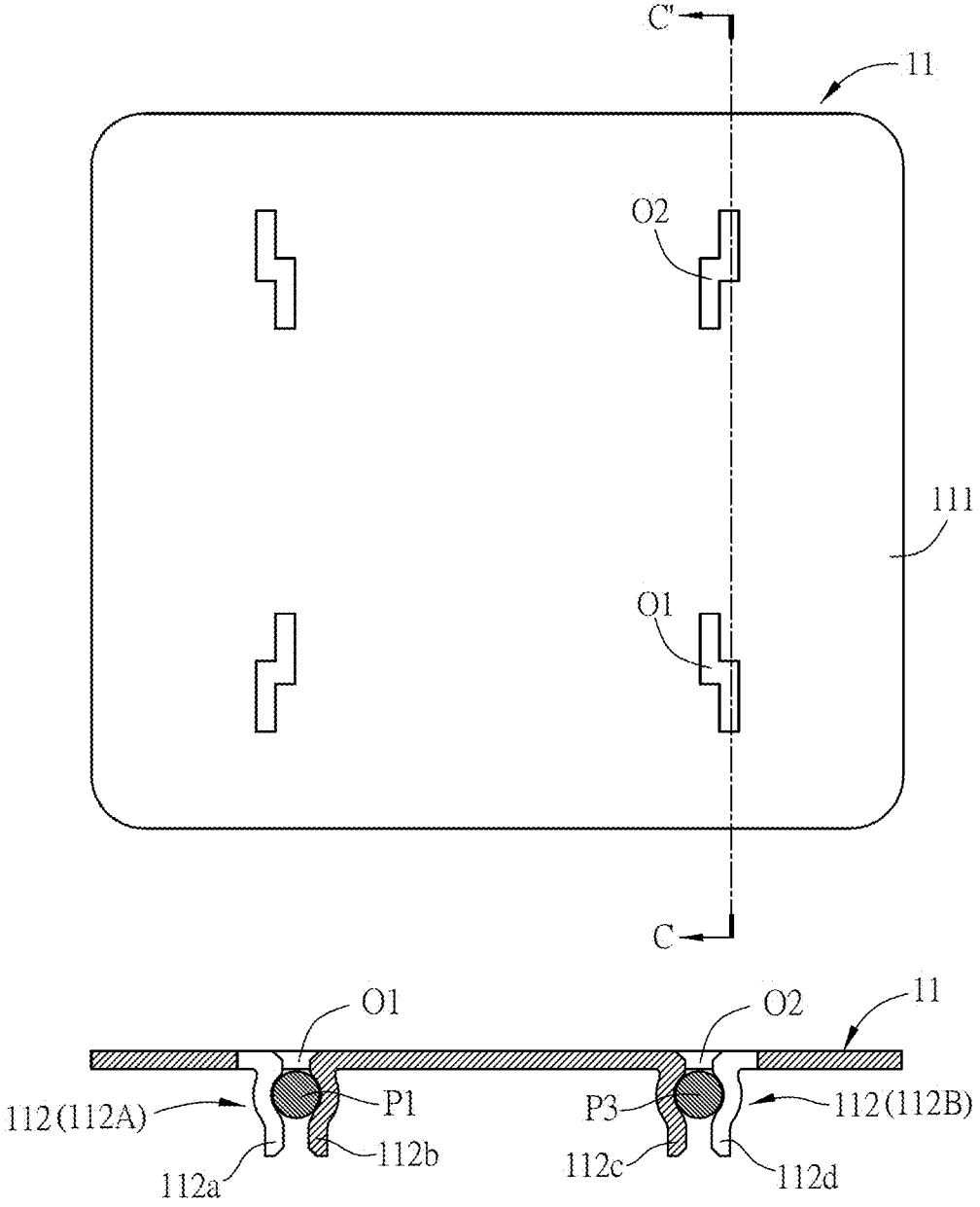
FIG. 3A to FIG. 3G are schematic diagrams showing a bending portion with different shapes.
Figure 3B:
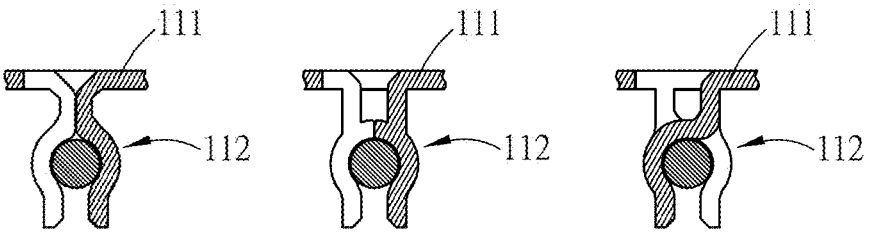

In an embodiment, the bending portion 112 shown in FIG. 3B is a duckbill type structure different from that shown in FIG. 3A.

Figure 3C:
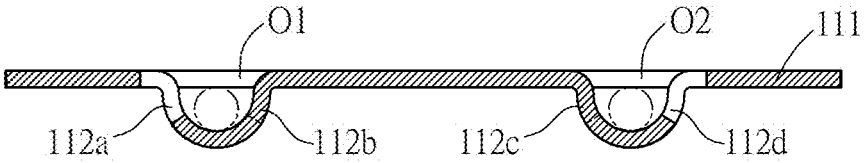

FIG. 3C shows another embodiment of the bending portion 112. In the section view, the bending portions 112*a*, 112*b* and the bending portions 112*c*, 112*d* are in a double circle structure.

Figure 3D:
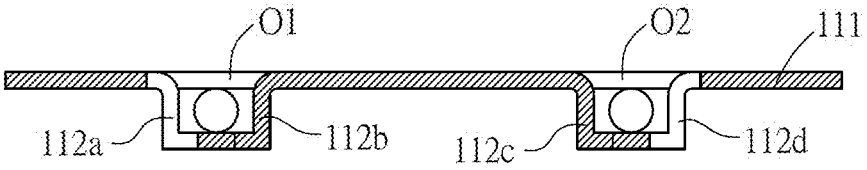

FIG. 3D shows another embodiment of the bending portion 112. In the section view, the bending portions 112*a*, 112*b* and the bending portions 112*c*, 112*d* are in a double slot structure.

Figure 3E:
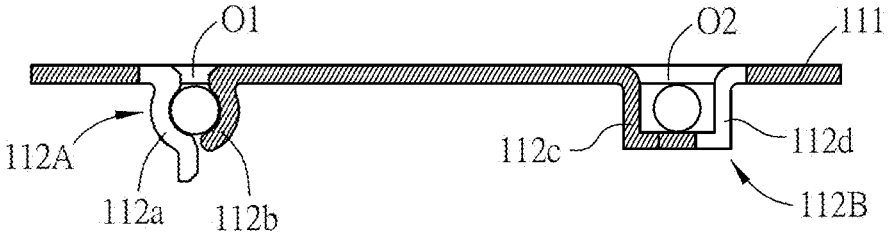

FIG. 3E shows another embodiment of the bending portion 112. In the section view, the shapes of the bending portions 112*a*, 112*b* and the bending portions 112*c*, 112*d* are different combinations of the above shapes. That is, the shape of the bending portions is varied.

In an embodiment, in FIG. 3A to FIG. 3E, the bending portions 112*a*, 112*b* are pivotally connected to a side of the first support 121. The bending portions 112*c*, 112*d* are pivotally connected to a side of the second support 122. The pivot mechanism is similar to that of the bending portions 112*a*, 112*b* and the first support 121.

Figure 3F:
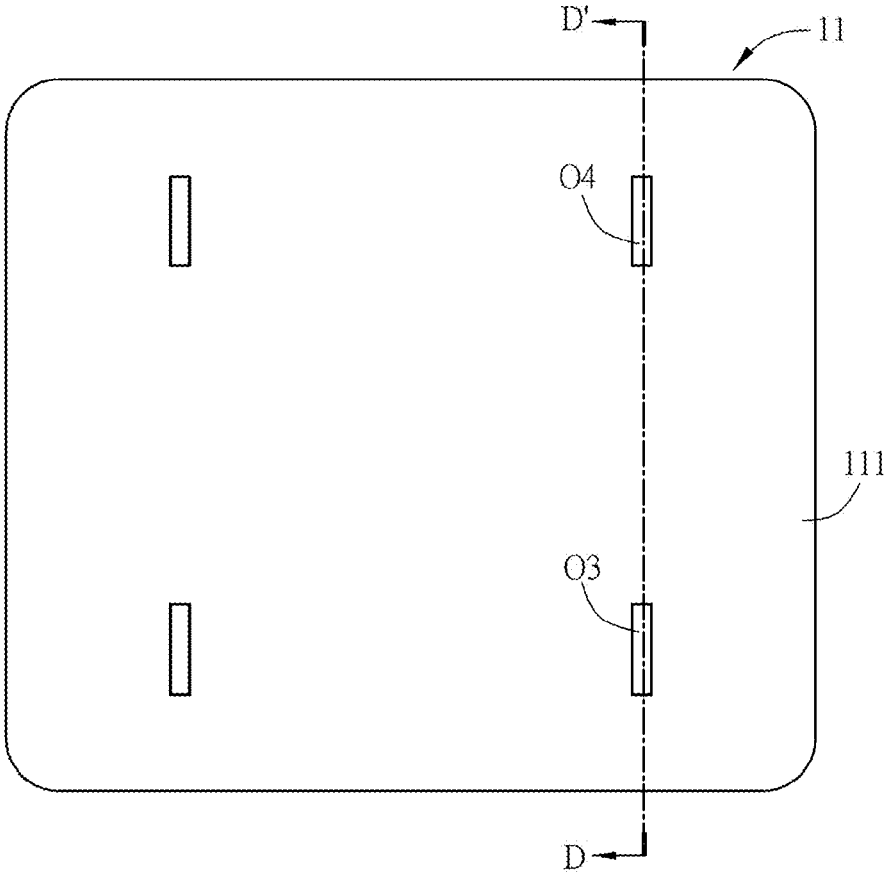
Figure 3F:
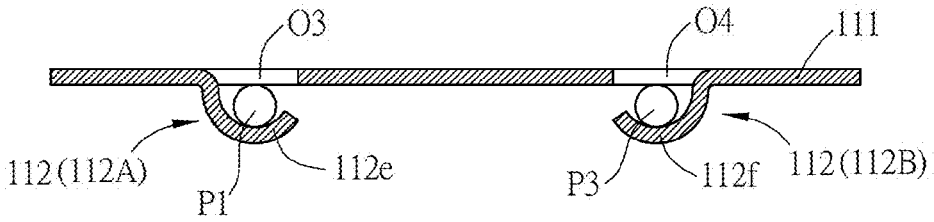

FIG. 3F is a top view showing a bending portion 112 and a section view along D-D' line in an embodiment. In the section view of the sheet metal keycap 11, the bending portion 112*e* is extended downward from the body portion 111 along a side of the punching hole O3 and combined with the first support 121 in the pivot position P1. That is, the bending portion 112*e* is formed at the body portion 111 of the sheet metal keycap 11 by punching to clamp a side of the first support 121. In the section view, the bending portion 112*e* is a hook structure. Similarly, the bending portion 112*f* is extended downward from the body portion 111 along a side of the punching hole O4 and combined with the second support 122 in the pivot position P3. In the section view, the bending portion 112*f* is a hook structure. In the section view, the bending portions 112*e*, 112*f* are a double hook structure.

Figure 3G:
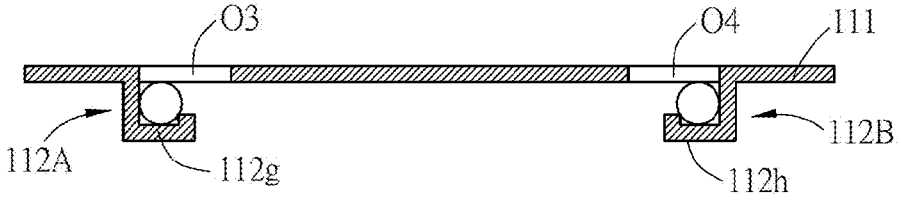

In an embodiment, the bending portions 112*g*, 112*h* shown in FIG. 3G are a double hook structure whose shape is different from the bending portions 112*e*, 112*f*.

In an embodiment, the sheet metal keycap 11 is made of a metal with high intensity. As a result, the thickness of the sheet metal keycap 11 can be reduced while the key 1 strength is satisfied. Additionally, the body portion 111 of the sheet metal keycap 11 and the bending portion 112 are integratedly formed. When the sheet metal keycap 11 is combined with the supporting structure 12, the bending portions 112 in FIG. 3A to FIG. 3G are pivotally connected with the first support 121 and the second support 122. As a result, an additional connecting structure does not need to be formed. The manufacture process is simplified.

Figure 4A:
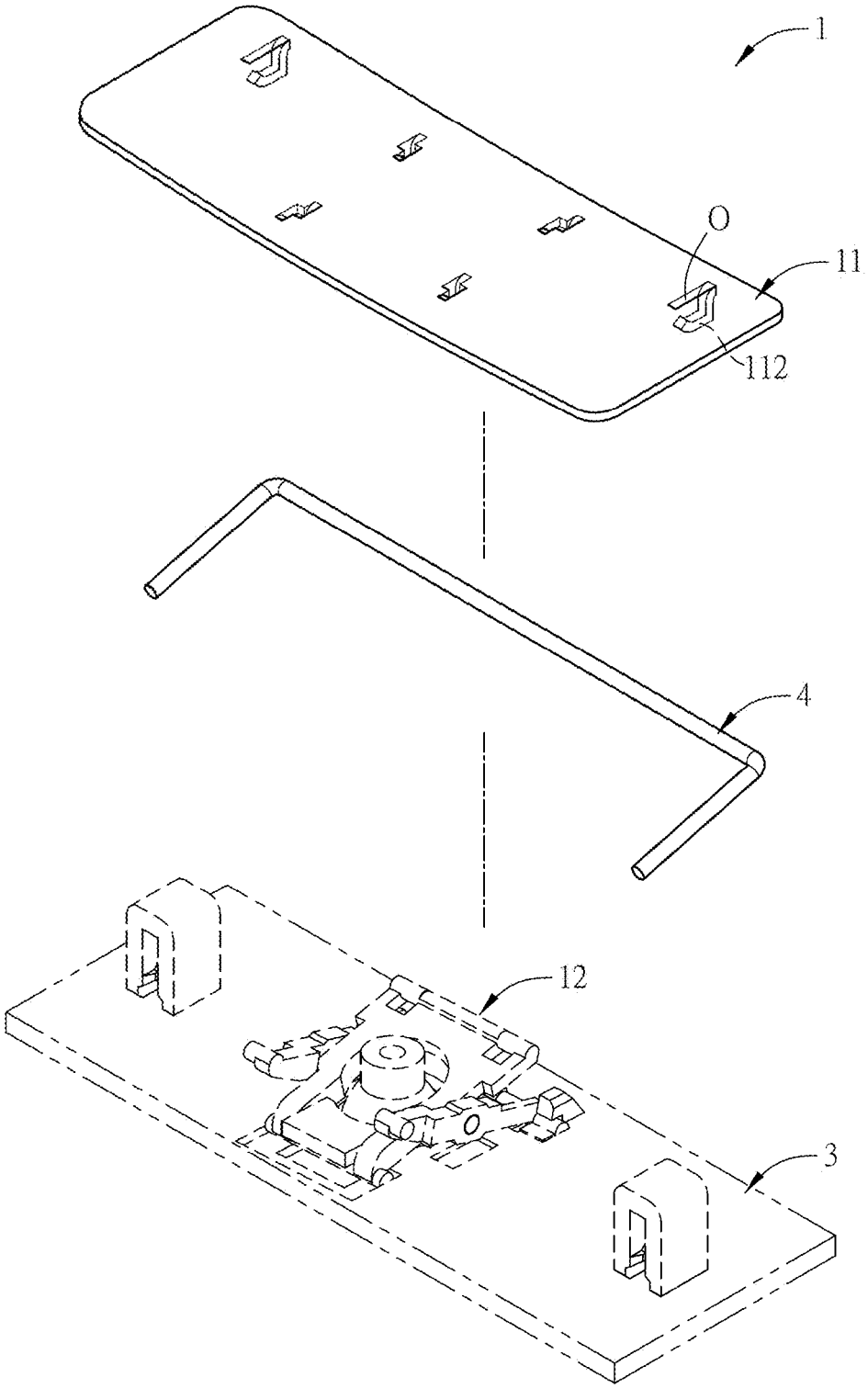
FIG. 4A is an exploded view showing a key shown in FIG. 1.
Figure 4B:
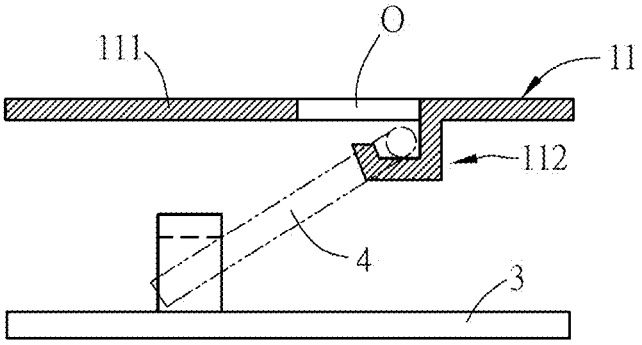
FIG. 4B is a section view showing a key along B-B' line in FIG. 1 in an embodiment.

FIG. 4A is an exploded view showing a key shown in FIG. 1. FIG. 4B is a section view showing a key along B-B' line in FIG. 1 in an embodiment. The key 1 further includes a metal bar 4. The metal bar 4 is fixed in the bending portion 112 with shapes that described in above embodiments. The metal bar 4 is disposed between the sheet metal keycap 11 and the baseplate 3. In other word, in an embodiment, the bending portion 112 is pivotally connected to the first support 121 and the second support 122, the metal bar 4 is fixed in the bending portion 112. Then, when any part of the surface of the body portion 111 of the sheet metal keycap 11 is pressed, the stress is average on the surface of the body portion 111 due to the metal bar 4. As a result, the sheet metal keycap 11 moves downwardly in a straight line which is perpendicular to the baseplate 3.

Figure 5:
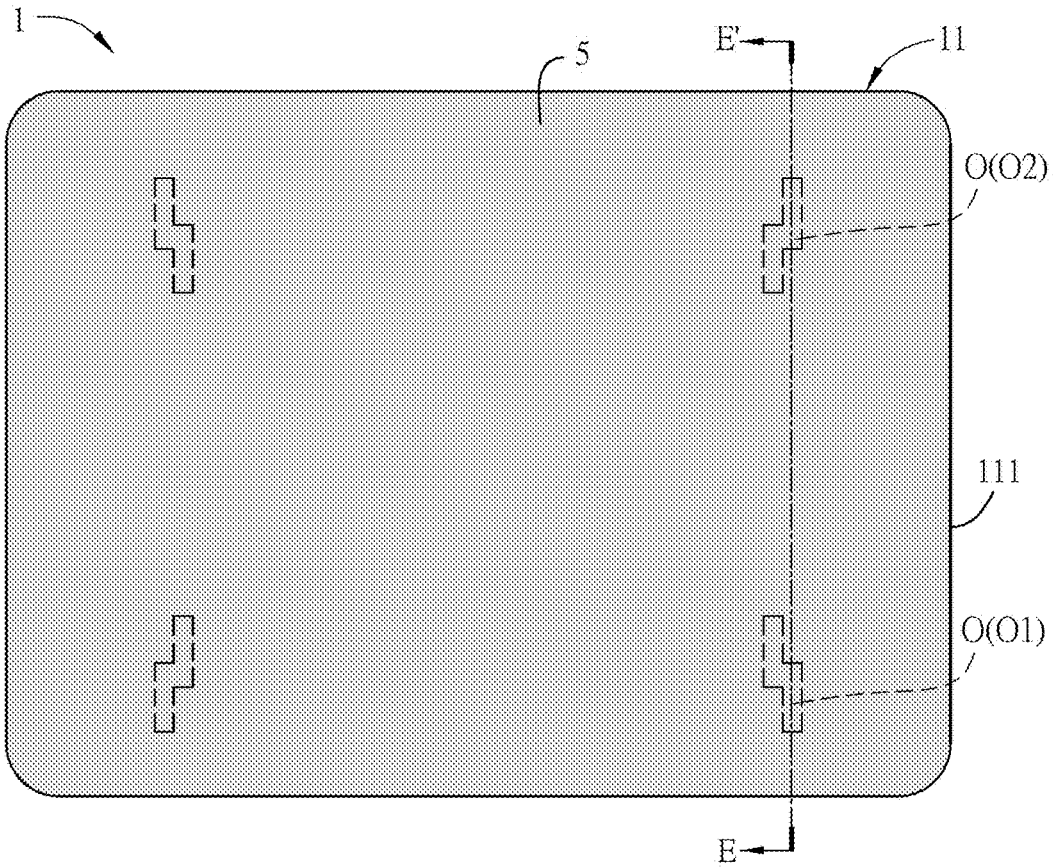
FIG. 5 is a schematic diagram showing a surface of a sheet metal keycap covering a film in an embodiment.
Figure 5:
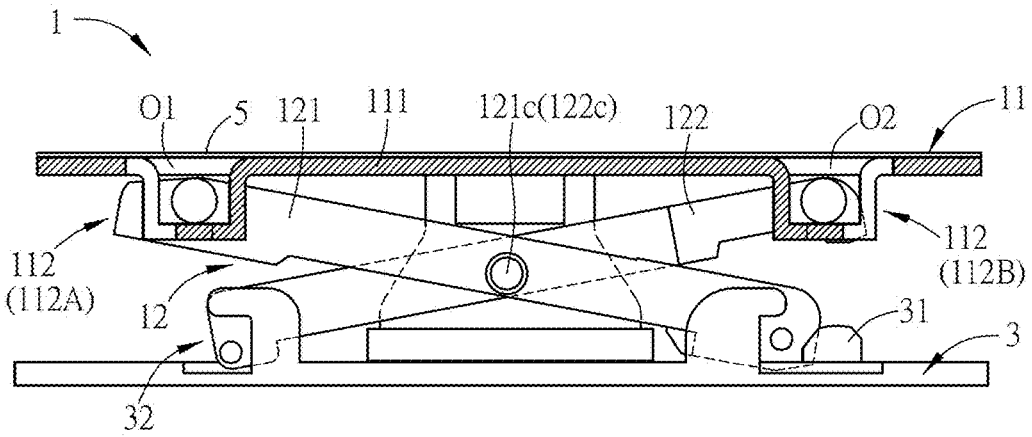

As shown in FIG. 5, in an embodiment, the sheet metal keycap 11 further includes a film 5. The film 5 covers on the surface of the body portion 111 and the punching hole O. As a result, the surface of the body portion 111 is covered and protected. Furthermore, the keycap looks more beautiful in its exterior appearance.

In an embodiment, the sheet metal keycap 11 is treated with an anodic surface treatment such as pull hair, laser engraving, or sandblasting. Comparing with the surface treatment for a conventional plastic keycap, it is diversified for the sheet metal keycap 11.

The key 1 and the keyboard device K are applied to an electronic device such as a notebook computer, or a tablet computer, or an ultrabook, which is not limited herein.

Comparing with a conventional plastic keycap, the thickness of the sheet metal keycap disclosed herein is reduced. Thus, the key and the keyboard can be produced thinner. Furthermore, lots of surface treatment that currently used in the area is applicable for the metal keycap.

In addition, the bending portion of the sheet metal keycap is punched from the body portion, and then a punching hole corresponding to the bending portion is formed. The shapes of the bending portions are a duckbill type, a double hook type, a double slot type or a double circle type. The shape of the bending portion is configured corresponding to the component to be connected. When a same keycap includes a plurality of bending portions, the shapes of the bending portions are the same or different. The connecting structure is not needed for the key and keyboard in embodiments of the disclosure. The sheet metal keycap and the bending portions are integratedly formed. Thus, the manufacturing process is simplified.

Although the invention has been disclosed with reference to certain embodiments thereof, the disclosure is not for limiting the scope. Persons having ordinary skill in the art may make various modifications and changes without departing from the scope of the invention. Therefore, the scope of the appended claims should not be limited to the description of the embodiments described above.

What is claimed is:

1. A key disposed on a baseplate of a keyboard device, the key comprising:

a sheet metal keycap including a body portion and two bending portions, wherein the body portion includes at least two punching holes corresponding to the bending portions, the at least two punching holes are disposed between an edge and a center of the body portion, and the two bending portions are extended downwardly from a side of the punching holes of the body portion, respectively; and a supporting structure, disposed between the sheet metal keycap and the baseplate, and two sides of the supporting structure are pivotally connected to the bending portions and the baseplate, respectively.

2. The key according to claim 1, wherein the bending portions are formed by bending the body portion after the punching holes are formed.

3. The key according to claim 1, wherein the sheet metal keycap further includes:

a film covering a surface of the body portion and the punching holes.

4. The key according to claim 1, wherein the supporting structure includes:

a first support, wherein a side of the first support is pivotally connected to the bending portions, and another side of the first support is pivotally connected to a fixing portion of the baseplate; and a second support, wherein a side of the second support is pivotally connected to the bending portions, another side of the second support is disposed in a slot of the baseplate, and a portion of the second support adjacent to a middle of the second support is pivotally connected to a portion of the first support adjacent to a middle of the first support.

5. The key according to claim 4, wherein when the sheet metal keycap is pressed, the sheet metal keycap moves downwardly in a straight line along a direction perpendicular to the baseplate, the first support and the sheet metal keycap are cooperated with each other and rotated via the pivot position, the second support and the sheet metal keycap are cooperated with each other and rotated via the pivot position and moves in a straight line along the slot.

6. The key according to claim 1, wherein the bending portions are a duckbill type, a double hook type, a double slot type or a double circle type.

7. The key according to claim 1, wherein the key further includes:

a metal bar fixed to the bending portions.

8. A keyboard device, comprising:

a baseplate, including a fixing portion and a slot, and a plurality of keys disposed on the baseplate, the key includes:

a sheet metal keycap including a body portion and two bending portions, wherein the body portion includes at least two punching holes corresponding to the bending portions, the at least two punching holes are disposed between an edge and a center of the body portion, and the two bending portions are extended downwardly from a side of the punching holes of the body portion, respectively; and a supporting structure, disposed between the sheet metal keycap and the baseplate, and two sides of the supporting structure are pivotally connected to the bending portions and the baseplate, respectively.

9. The keyboard device according to claim 8, wherein the bending portions are a duckbill type, a double hook type, a double slot type or a double circle type.

10. The keyboard device according to claim 8, further comprising:

a metal bar fixed to the bending portions.

* * * * *